US006711233B2

(12) United States Patent
Hertz et al.

(10) Patent No.: US 6,711,233 B2
(45) Date of Patent: Mar. 23, 2004

(54) METHOD AND APPARATUS FOR GENERATING X-RAY OR EUV RADIATION

(75) Inventors: Hans Martin Hertz, Stocksund (SE); Oscar Hemberg, Stockholm (SE)

(73) Assignee: Jettec AB, Lund (SE)

( * ) Notice: Subject to any disclaimer, the term of this patent is extended or adjusted under 35 U.S.C. 154(b) by 293 days.

(21) Appl. No.: 09/910,073

(22) Filed: Jul. 23, 2001

(65) Prior Publication Data

US 2002/0015473 A1 Feb. 7, 2002

Related U.S. Application Data

(60) Provisional application No. 60/229,125, filed on Aug. 31, 2000.

(30) Foreign Application Priority Data

Jul. 28, 2000 (SE) ..... 0002785

(51) Int. Cl.[7] ..... H01J 35/08

(52) U.S. Cl. ..... 378/143; 378/119; 378/124; 378/125

(58) Field of Search ..... 378/143, 119, 378/125, 124

(56) References Cited

U.S. PATENT DOCUMENTS

| | | | | |
|---|---|---|---|---|
| 4,723,262 A | * | 2/1988 | Noda et al. | 378/119 |
| 4,953,191 A | * | 8/1990 | Smither et al. | 378/143 |
| 5,577,091 A | * | 11/1996 | Richardson et al. | 378/119 |
| 5,577,092 A | | 11/1996 | Kublak et al. | |
| 5,978,444 A | * | 11/1999 | Atac et al. | 378/73 |
| 6,002,744 A | * | 12/1999 | Hertz et al. | 378/119 |
| 6,011,267 A | | 1/2000 | Kubiak et al. | |
| 6,069,937 A | | 5/2000 | Oshino et al. | |
| 6,324,255 B1 | * | 11/2001 | Kondo et al. | 378/119 |
| 6,469,310 B1 | * | 10/2002 | Fiedorowicz et al. | 250/492.22 |

FOREIGN PATENT DOCUMENTS

| | | |
|---|---|---|
| EP | 0 186 491 A2 | 7/1986 |
| JP | 5-258692 | 10/1993 |
| WO | WO 97/40650 A1 | 10/1997 |
| WO | WO 99/34395 A1 | 7/1999 |

OTHER PUBLICATIONS

Ter–avertisyan et al. "Soft X–ray Emission of E–bean Excited Clustered Supersonic Gas Jet" *Institute of Physical Research of the National Armenian Academy of Sciences* (Ashtarak–2,378410, Armenia.

Malmqvist et al. "Liquid–jet Target For Laser–plasma Soft X–ray Generation" *American Institute of Physics,* (Sep. 1996) pp. 4150–4153.

Kubiak et al "Debris–Free EUVL Sources Based on Gas Jets" Optical Society of America, *OSA On Extreme Ultra-violet Lithograph*, 1996 vol. 4.

* cited by examiner

*Primary Examiner*—Craig E Church
*Assistant Examiner*—Jurie Yun
(74) *Attorney, Agent, or Firm*—Burns, Doane, Swecker & Mathis, L.L.P.

(57) ABSTRACT

In a method and an apparatus for generating X-ray or EUV radiation, an electron beam is brought to interact with a propagating target jet, typically in a vacuum chamber. The target jet is formed by urging a liquid substance under pressure through an outlet opening. Hard X-ray radiation may be generated by converting the electron-beam energy to Bremsstrahlung and characteristic line emission, essentially without heating the jet to a plasma-forming temperature. Soft X-ray or EUV radiation may be generated by the electron beam heating the jet to a plasma-forming temperature.

44 Claims, 1 Drawing Sheet

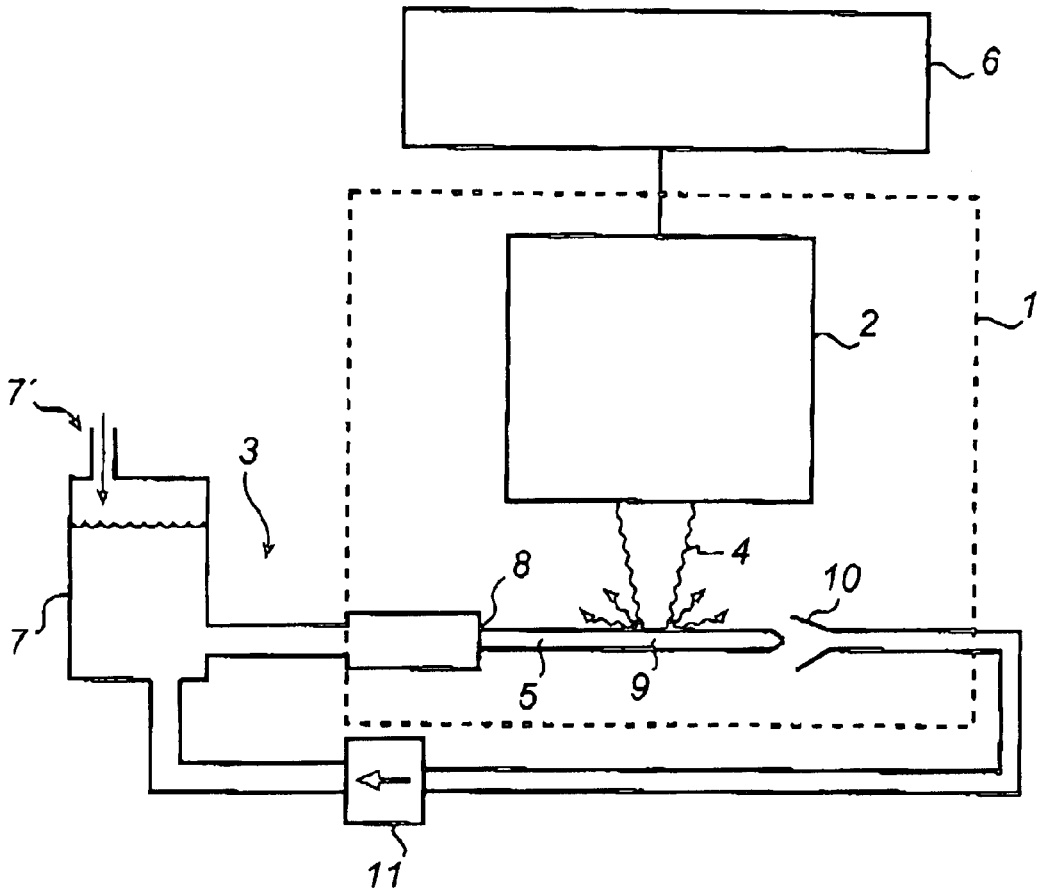
6
1
2
7'
3
4
8
10
7
5
9
11

METHOD AND APPARATUS FOR GENERATING X-RAY OR EUV RADIATION

This application claims priority under 35 U.S.C. §§ 119 and/or 365 to Application No. 0002785-4 filed in Sweden on Jul. 28, 2000 and Provisional Application No. 60/229,125, filed in the United States of America on Aug. 31, 2000.

TECHNICAL FIELD

The present invention generally relates to a method and an apparatus for generating X-ray or extreme ultraviolet (EUV) radiation, especially with high brilliance. The generated radiation can for example be used in medical diagnostics, non-destructive testing, lithography, microscopy, materials science, or in some other X-ray or EUV application.

BACKGROUND ART

X-ray sources of high power and brilliance are applied in many fields, for instance medical diagnostics, non-destructive testing, crystal structural analysis, surface physics, lithography, X-ray fluorescence, and microscopy.

In some applications, X-rays are used for imaging the interior of objects that are opaque to visible light, for example in medical diagnostics and material inspection, where 10–1000 keV X-ray radiation is utilized, i.e. hard X-ray radiation. Conventional hard X-ray sources, in which an electron beam is accelerated towards a solid anode, generate X-ray radiation of relatively low brilliance. In hard X-ray imaging, the resolution of the obtained image basically depends on the distance to the X-ray source and the size of the source. The exposure time depends on the distance to the source and the power of the source. In practice, this makes X-ray imaging a trade-off between resolution and exposure time. The challenge has always been to extract as much X-ray power as possible from as small a source as possible, i.e. to achieve high brilliance. In conventional solid-target sources, X-rays are emitted both as continuous Bremsstrahlung and characteristic line emission, wherein the specific emission characteristics depend on the target material used. The energy that is not converted into X-ray radiation is primarily deposited as heat in the solid target. The primary factor limiting the power, and the brilliance, of the X-ray radiation emitted from a conventional X-ray tube is the heating of the anode. More specifically, the electron-beam power must be limited to the extent that the anode material does not melt. Several different schemes have been introduced to increase the power limit. One such scheme includes cooling and rotating the anode, see for example Chapters 3 and 7 in "Imaging Systems for Medical Diagnostics", E. Krestel, Siemens Aktiengesellschaft, Berlin and Munich, 1990. Although the cooled rotating anode can sustain a higher electron-beam power, its brilliance is still limited by the localized heating of the electron-beam focal spot. Also the average power load is limited since the same target material is used on every revolution. Typically, very high intensity sources for medical diagnostics operate at 100 kW/mm.sup.2, and state of the art low-power micro-focus devices operate at 150 kW/mm.sup.2.

Applications in the soft X-ray and EUV wavelength region (a few tens of eV to a few keV) include, e.g., next generation lithography and X-ray microscopy systems. Ever since the 1960s, the size of the structures that constitute the basis of integrated electronic circuits has decreased continuously. The advantage thereof is faster and more complex circuits requiring less power. At present, photolithography is used to industrially produce such circuits having a line width of about 0.13 $\mu$m. This technique can be expected to be applicable down to about 0.1–0.07 $\mu$m. In order to further reduce the line width, other methods will probably be necessary, of which EUV projection lithography is a strong candidate, see for example "International Technology Roadmap for Semiconductors", International SEMATECH, Austin Tex., 1999. In EUV projection lithography use is made of a reducing EUV objective system in the wavelength range around 10–20 nm.

In the soft X-ray and EUV region, compared to the conventional generation of hard X-ray radiation as discussed above, a different scheme for generation of radiation is normally used since the conversion efficiency from electron-beam energy into soft X-ray radiation, in solid targets, generally is too low to be useful. A common technique for generation of soft X-ray and EUV radiation is instead based on heating of the target material for production of a hot, dense plasma using intense (around $10^{10}$–$10^{13}$ W/cm$^2$) laser radiation, such as disclosed in Chapter 6 in "Soft X-rays and Extreme Ultraviolet Radiation: principles and application", D. T. Attwood, Cambridge University Press, 1999. These so-called laser produced plasmas (LPP) emit both continuous radiation and characteristic line emission, wherein the specific emission characteristics depend on target material and plasma temperature. Traditional LPP X-ray sources, using a solid target material, are hampered by unwanted emission of debris as well as limitations on repetition rate and uninterrupted usage, since the delivery of target material becomes a limiting factor. This has lead to the development of regenerative, low debris targets including gas jets (see for example U.S. Pat. No. 5, 577,092, and the article "Debris-free EUVL sources based on gas jets" by Kubiak et al, published in OSA Trends in Optics and Photonics, No. 4, p. 66, 1996), and liquid jets (see for example U.S. Pat. No. 6,002,744, and the article "Liquid-jet target for laser-plasma soft x-ray generation" by Malmqvist et al, published in Review of Scientific Instruments, No. 67, p. 4150, 1996). These targets have been extensively used in LPP soft X-ray and EUV sources. However, the applicability of LPP sources is limited by the relatively low conversion efficiency of electrical energy into laser light and then of laser light into X-ray radiation, necessitating the use of expensive high-power lasers.

Quite recently, electron-beam excitation of a gas-jet target has been tested for direct, non-thermal generation of soft X-ray radiation, albeit with relatively low power and brilliance of the resulting radiation, see Ter-Avetisyan et al, Proceedings of the SPIE, No. 4060, pp 204–208, 2000.

There are also large facilities such as synchrotron light sources, which produce X-ray radiation with high average power and brilliance. However, there are many applications that require compact, small-scale systems that produce X-ray radiation with a relatively high average power and brilliance. Compact and more inexpensive systems yield better accessibility to the applied user and thus are of potentially greater value to science and society.

SUMMARY OF THE INVENTION

It is an object of the present invention to solve or alleviate the problems described above. More specifically, the invention aims at providing a method and an apparatus for generation of X-ray or EUV radiation with very high brilliance in combination with relatively high average power.

It is also an object of the invention to provide a compact and relatively inexpensive apparatus for generation of X-ray or EUV radiation.

The inventive technique should also provide for stable and uncomplicated generation of X-ray or EUV radiation, with minimum production of debris.

A further objective is to provide a method and an apparatus generating radiation suitable for medical diagnostics and material inspection.

Still another object of the invention is to provide a method and an apparatus suitable for use in lithography, non-destructive testing, microscopy, crystal analysis, surface physics, materials science, X-ray photo spectroscopy (XPS), X-ray fluorescence, protein structure determination by X-ray diffraction, and other X-ray applications.

These and other objectives, which will be apparent from the following description, are wholly or partially achieved by the method and the apparatus according to the appended independent claims. The dependent claims define preferred embodiments.

Accordingly, the invention provides a method for generating X-ray or EUV radiation, comprising the steps of forming a target jet by urging a liquid substance under pressure through an outlet opening, which target jet propagates through an area of interaction; and directing at least one electron beam onto the target jet in the area of interaction such that the electron beam interacts with the target jet to generate X-ray or EUV radiation.

Depending on the material of the target jet, the temperature, speed and diameter of the jet, as well as on the current, voltage and focal spot size of the electron beam, the inventive method and apparatus allows for operation in either of two modes. In a first mode of operation, hard X-ray radiation is generated by direct conversion of the electron-beam energy to Bremsstrahlung and characteristic line emission, essentially without heating the jet to a plasma-forming temperature. In the second mode of operation, soft X-ray or EUV radiation is generated by heating the jet to a plasma-forming temperature. In either mode of operation, the invention provides significant improvements over prior-art technology In the first mode of operation, the jet target provides several advantages over the solid anode conventionally used in generation of hard X-ray radiation. More specifically, the liquid jet has a density high enough to allow for high brilliance and power of the generated radiation. Further, the jet is regenerative to its nature so there is no need to cool the target material. In fact, the target material can be destroyed, i.e. heated to a temperature above its melting temperature, due to the regenerative nature of the jet target. Thus, the electron-beam power density at the target may be increased significantly compared to non-regenerative targets. In addition, the jet can be given a very high propagation speed through the area of interaction. Compared to conventional stationary or rotating anodes, more energy can be deposited in such a fast propagating jet due to she correspondingly high rate of material transport into the area of interaction. The combination of these features allows for a significant increase in brilliance of the generated hard X-ray radiation. Thus, the use of a small, high-density, regenerative, high-speed target in the form of a jet, formed by urging a liquid substance under pressure through an outlet opening, should typically allow for a 100-fold increase in brilliance of the generated hard X-ray radiation compared to conventional techniques.

In order to achieve the power density allowed for by this novel, regenerative target, the electron beam should preferably be properly focused thereon. Typically, the acceleration voltage used for generating the electron beam will be in the order of 5–500 kV, but might be higher. The beam current will typically be in the order of 10–1000 mA, but might be higher.

The second mode of operation emanates from the basic insight that at least one electron beam can be used instead of a laser beam to form a plasma emitting soft X-ray or EUV radiation. Compared to the conventional equipment based on the above-discussed LPP concept, the inventive method and apparatus allows for a significant increase in wall-plug conversion efficiency, as well as lower cost and complexity. Other attractive features include low emission of debris, essentially no limitation on repetition rate, and uninterrupted usage.

In the second mode of operation, the electron source should typically deliver in the order of $10^{10}$–$10^{13}$ W/cm$^2$ to the area of interaction in order to establish the desired plasma temperature. This could be easily achieved by operating the electron source to generate a pulsed electron beam, wherein the pulse length preferably is matched to the size of the jet. The repetition rate of the electron source then determines the average power of the generated X-ray or EUV radiation. When using a pulsed electron beam, the jet might be disturbed by the discontinuous interaction with the electron beam. To this end, the jet propagation speed should preferably be so high that the jet is capable of stabilizing between each electron-beam pulse.

It should be noted that the electron beam can be pulsed or continuous in either of the first and second modes.

In both modes of operation, for optimum utilization of the accessible electron beam power, the beam is preferably focused on the jet to essentially match the size of the beam to the size of the jet. In this context it is possible to use a line focus instead of a point focus, the transverse dimensions of the line focus being essentially matched to the transverse dimensions of the jet. The jet is preferably generated with a diameter of about 1–100 $\mu$m but may be as large as millimeters. Thereby, the radiation will be emitted with high brilliance from a small area of interaction. To better utilize the generated radiation, the inventive apparatus and method may naturally be used in conjunction with X-ray optics, such as polycapillary lenses, compound refractive lenses or X-ray mirrors.

Preferably, the target jet is generated by urging a liquid substance through an outlet opening, such as a nozzle or an orifice, typically by means of a pump and/or a pressurized reservoir yielding a pressure typically in the range of 0.5–500 MPa to bring about a jet propagation speed of about 10–1000 m/s from the outlet opening. The substance is not limited to materials normally in a liquid state, but may also include a solid, for example a metal, heated to a liquid state before being urged through the outlet opening, or a gas, for example a noble gas, cooled to a liquid state before being urged through the outlet opening. Alternatively, the substance can comprise materials dissolved in a carrier liquid, It is also conceivable to urge a gaseous substance through the outlet opening, provided that the gaseous substance is capable of forming a liquid jet after being urged through the outlet opening. After its formation, the jet may attain different hydrodynamic states. Slow jets are normally laminar and break up into droplets under the influence of surface tension while fast jets are more or less turbulent and are spatially continuous in a transitional region before they turn into a spray. Any type of hydrodynamic state of the jet may be employed with the inventive technique. In another conceivable embodiment, the jet is allowed to freeze to a solid state before interacting with the electron beam.

Further, depending on the type of substance, the jet may be electrically conductive or not. This has implications on the transport of charge deposited in the jet at the area of interaction. If the jet is electrically conductive, the charge can be removed through the jet itself such that the jet will remain at essentially ground potential. On the other hand, if the jet is non-conductive, the deposited charge can be removed from the area of interaction by the motion of the jet itself. Any build-up of charge at the area of interaction might influence the electron-beam focusing. With a non-conductive jet, a high jet propagation speed could be favorable to minimize the build-up of charge.

The gas atmosphere may vary within the inventive apparatus. The necessary layout of the gas atmosphere in the apparatus depends on both the desired wavelength of the generated radiation and the type of electron source. Typically, the need for a vacuum environment is higher at the electron source than at the area of interaction, It is possible to use localized gas pressures and differential pumping schemes to maintain different pressures in different parts of the apparatus.

BRIEF DESCRIPTION OF THE DRAWING

The invention will now be described for the purpose of exemplification with reference to the accompanying drawing, which illustrates a currently preferred embodiment and is a schematic view of an inventive apparatus for generating X-ray or EUV radiation by interaction of an electron beam and a liquid jet.

DESCRIPTION OF PREFERRED EMBODIMENTS

The apparatus shown in the drawing includes a chamber 1, an electron source 2, and a target generator 3. The electron source 2 is arranged to emit a pulsed or continuous electron beam 4 into the chamber 1 and focus the beam 4 on a target 5, which is generated by the target generator 3. Although not shown in the drawing, more than one electron beam 4 may be generated, the beams 4 being focused from one or more directions on the target 5. The electron source 2, which incorporates acceleration and focusing elements (not shown), can be of conventional construction and is powered by a voltage power supply 6. Depending on the desired characteristics of the electron beam 4, the electron source 2 might be anything from a simple cathode source to a complex high-energy source such as a racetrack.

As will be further described below, X-ray or EUV radiation (indicated by arrows in the drawing) is generated by the beam 4 interacting with the target 5 inside the chamber 1. Normally, a vacuum environment is provided in the chamber 1, due to requirements of the electron source 2. Furthermore, the high absorption of soft X-ray and EUV radiation in matter often necessitates a high-vacuum environment.

For the formation of a microscopic and spatially stable target 5 in a vacuum environment, the target generator 3 is arranged to generate a spatially continuous jet 5 from a substance in a liquid state. The target generator 3 shown in the drawing includes a reservoir 7 and a jet-forming outlet opening 8, typically a nozzle opening, which is connected to a liquid outlet of the reservoir 7 and opens in the chamber 1. The reservoir 7 holds the substance from which the jet 5 is to be formed. Depending on the type of substance, the reservoir 7 can be provided with cooling or heating elements (not shown) to maintain the substance in a liquid state while it is being urged through the outlet opening 8 at high pressure, normally 0.5–500 MPa, typically by feeding high-pressure gas to a gas inlet 7' of the reservoir 7. The diameter of the outlet opening 8 is typically smaller than about 100 $\mu$m. The resulting jet 5, which is stable and microscopic and has essentially the same diameter as the outlet opening 8, typically propagates at a speed of about 10–1000 m/s in the chamber 1. Although not shown in the drawing, the jet 5 could propagate to a break-up point where it spontaneously breaks up into droplets or a spray, depending on the operating parameters of the target generator 3. The distance to the break-up point is essentially determined by the hydrodynamic properties of the liquid substance, the dimensions of the outlet 8 and the speed of the liquid substance.

When the liquid substance leaves the outlet opening 8, it is cooled by evaporation. It is therefore conceivable that the jet 5 may freeze, such that no droplets or sprays are formed.

As shown in the drawing, the electron beam 4 impinges on the jet 5 before the jet 5 spontaneously, or by stimulation, breaks up into droplets, i.e. while it is still a small collimated jet. Thus, the area of interaction 9 between the beam 4 and the jet 5 is located on a spatially continuous portion of the jet 5, i.e. a portion having a length that significantly exceeds the diameter. Thereby, the apparatus can be continuously or semicontinuously operated to generate X-ray or EUV radiation, as will be described below. Further, this approach results in sufficient spatial stability of the jet 5 to permit the focal spot of the electron beam 4 on the jet 5 to be of approximately the same size as the diameter of the jet 5. In the case of a pulsed electron beam 4, this approach also alleviates the need for any temporal synchronization of the electron source 2 with the target generator 3. In some cases, similar advantages can be obtained with jets consisting of separate, spatially continuous portions. It should be emphasized, however, that any formation of condensed matter emanating from a liquid jet can be used as target for the electron-beam within the scope of the invention, be it liquid or solid, spatially continuous, droplets, or a spray of droplets or clusters.

By properly adapting the characteristics of the electron beam 4 in relation to the characteristics of the target 5, the interaction of the beam 4 with the jet 5 results, in a first mode of operation, in that radiation is emitted from the area of interaction 9 by direct conversion, essentially without heating the jet 5 to a plasma-forming temperature. In a second mode of operation, these characteristics are adapted such that the jet 5 is heated to a suitable plasma-forming temperature. The choice of mode depends on the desired wavelength range of the generated radiation. A plasma-based operation is most effective for generating soft X-ray and EUV radiation, i.e. in the range from a few tens of eV to a few keV, whereas as an essentially non-plasma, direct conversion operation is more efficient for generation of harder X-rays, typically in the range from about 10 keV to about 1000 keV.

In the following, the operation of the apparatus in the first and second modes will be discussed in general terms. Examples of conceivable realizations are also given, without limiting the disclosure to these examples.

In the first mode of operation, which is primarily intended for generation of hard X-ray radiation to be used in, inter alia, medical diagnosis diagnostics, the electron source 2 is controlled in such a manner, in relation to the characteristics of the target 5, that essentially no plasma is formed at the area of interaction 9. Thereby, hard X-ray radiation is obtained via Bremsstrahlung and characteristic line emission. It is preferred that the distance from the outlet opening 8 to the area of interaction 9 is sufficiently long, typically 0.5–10 mm, so that the beam-jet-interaction does not damage the outlet. In one conceivable realization, use is made of a jet 5 of liquid metal having a diameter of about 30 .mu.m and a propagation speed of about 600 m/s, the jet 5 being irradiated about 10 mm away from the outlet opening 8 by means of an electron beam 4 of about 100 mA and 100 keV, the beam 4 being focused on the jet 5 to obtain a power density of about 10 MW/mm.sup.2 in the area of interaction 9. This power density is roughly a factor of 100 better than in conventional solid-target systems, as discussed by way of introduction. By means of the invention, a high-resolution image can be obtained with a low exposure time. In this first mode of operation, the jet 5 is preferably formed from metals heated to a liquid state. In this context, tin (Sn) should be easy to use, although other metals or alloys may be used for generation of radiation in a desired wavelength range. Further, it is also conceivable to use completely different substances for generating the jet 5, such as gases cooled to a liquid state or material dissolved in a carrier liquid.

The apparatus operating in the first mode can include a window (not shown) transparent to X-rays for extracting the generated radiation from the chamber 1 to the exterior where patients, or other objects, can be imaged. By using a microscopic liquid jet 5 as a target, the size of the X-ray radiation is generated from a very small area of interaction 9, resulting in a high brilliance.

In the second mode of operation, which is primarily intended for generation of soft X-ray and/or EUV radiation to be used in, inter alia, EUV projection lithography, the electron source 2 is controlled in such a manner, in relation to the characteristics of the target 5, that a plasma at a suitable temperature is formed at the area of interaction 9. Thereby, soft X-ray radiation and/or EUV radiation is obtained via continuous and characteristic line emission. Preferably, a pulsed electron beam 4 irradiates the jet 5, whereby the electron source 2 is controlled to form a plasma by every electron-beam pulse. It is preferred that the distance from the outlet opening 8 to the point of interaction 9 is sufficiently long, typically 0.5–10 mm, so that the created plasma does not damage the outlet. In one conceivable realization, use is made of a jet 5 of liquid noble gas having a diameter of about 30 $\mu$m and a propagation speed of about 50 m/s, the jet 5 being irradiated about 10 mm away from the outlet opening 8 by means of a pulsed electron beam 4 of about 10 A and 1 MeV operated at a repetition rate of about 50 kHz with a pulse length of about 5 ns, the beam 4 being focused on the jet 5 to obtain a power density of about $10^{12}$ W/cm$^2$ per pulse in the area of interaction 9 and an average electron beam power of 2.5 kW. Such a system would roughly provide the EUV power needed for the next generation EUV projection lithography systems.

In this second mode of operation, the specific characteristics of the electron beam 4 are not crucial as long as the average power thereof is high enough and the pulse power and pulse time are matched to the target in order to obtain the appropriate plasma-forming temperature in the area of interaction 9. In the second mode of operation, the jet 5 is preferably formed from a noble gas cooled to a liquid state, to avoid coating of sensitive components within the apparatus. For example, it is known from laser-plasma studies that liquefied xenon results in strong X-ray emission in the wavelength range of 10–15 nm (see for example the article "Xenon liquid-jet laser-plasma source for EUV lithography", by Hansson et al, published in Proceedings of the SPIE, vol. 3997, 2000). Besides liquefied noble gases, it is conceivable to use completely different substances for generating the jet, such as material dissolved in a carrier liquid or liquefied metals.

An apparatus operating in the second mode and being designed for use in lithography or microscopy can include a collector system of multi-layer mirrors (not shown) that collects a large portion of the created EUV or soft x-ray radiation and transports it to illumination optics and the rest of the lithography/microscopy system. By using a microscopic target in the form of a jet 5 generated from a liquid substance, the production of debris will be very low. The inventive apparatus operating in the second mode has the potential of providing the same performance as an LPP system but at a lower price since multi kilowatt lasers are very complicated and expensive. Furthermore, the wall-plug conversion efficiency is much higher for electron sources than for lasers.

It should also be noted that, when the electron source 2 is operated for first-mode X-ray generation and/or emits pulsed electron radiation, a large portion of the liquid substance may remain unaffected by the electron beam 4 and propagate unhindered through the chamber 1. This would result in an increase of pressure in the vacuum chamber 1 owing to evaporation. This problem can be solved, for instance, by a using a differential pumping scheme, indicated in the drawing, where the jet 5 is collected at a small aperture 10 and then recycled to the reservoir 7 by means of a pump 11 that compresses the collected substance and feeds it back to the reservoir 7.

It should be realized that the inventive method and apparatus can be used to provide radiation for medical diagnostics, non-destructive testing, lithography, crystal analysis, microscopy, materials science, microscopy-surface physics, protein structure determination by X-ray diffraction, X-ray photo spectroscopy (XPS), X-ray fluorescence, or in some other X-ray or EUV application.

What is claimed is:

1. A method for generating X-ray radiation, comprising the steps of:

(i) forming a target jet by urging a liquid substance under pressure through an outlet opening, the target jet propagating through an area of interaction, (ii) directing at least one electron beam onto the target jet in the area of interaction such that the electron beam interacts with the target jet to generate X-ray radiation, and (iii) controlling the electron beam to interact with the jet at an intensity such that Bremsstrahlung and characteristic line emission is generated in the X-ray region wherein the target jet is formed to have a sufficiently high propagation speed in the area of interaction in order for the emission to be generated essentially without heating the jet to a plasma-forming temperature, the propagation speed being at least 10 m/s in the area of interaction.

2. A method according to claim 1, wherein the substance comprises a solid material, heated to a liquid state.

3. A method according to claim 2, wherein the solid material is a metal.

4. A method according to claim 1, wherein the substance comprises a gas, cooled to a liquid state.

5. A method according to claim 4, wherein the gas is a noble gas.

6. A method according to claim 1, wherein the electron beam interacts with the jet at a distance from about 0.5 mm to about 10 mm from the outlet opening.

7. A method according to claim 1, wherein the target jet is in a solid state in the area of interaction.

8. A method according to claim 1, wherein the target jet is in a liquid state in the area of interaction.

9. A method according to claim 8, wherein the electron beam interacts with at least one droplet in the area of interaction.

10. A method according to claim 8, wherein the electron beam interacts with a spray of droplets or clusters in the area of interaction.

11. A method according to claim 1, wherein the electron beam interacts with a spatially continuous portion of the target jet in the area of interaction.

12. A method according to claim 1, wherein the electron beam is focused on the target jet to essentially match a transverse dimension of the electron beam to a transverse dimension of the jet.

13. A method according to claim 1, wherein the target jet is formed with a diameter from about 1 $\mu$m to about 10,000 $\mu$m.

14. A method according to claim 1, wherein the electron beam is generated by means of an acceleration voltage from about 5 kV to about 500 kV and an average beam current from about 10 mA to about 1000 mA.

15. A method according to claim 14, wherein the target jet is formed to have a propagation speed on the order of 10–1000 m/s in the area of interaction.

16. A method according to claim 14, wherein the target jet is formed to have a propagation speed of about 600 m/s in the area of interaction.

17. A method according to claim 1, wherein at least one pulsed electron beam is directed onto the target jet.

18. A method according to claim 1, wherein at least one continuous electron beam is directed onto the target jet.

19. A method according to claim 1, further comprising the step of performing medical diagnostics with the X-ray or EUV radiation.

20. A method according to claim 1, further comprising the step of performing non-destructive analysis with the X-ray or EUV radiation.

21. A method according to claim 1, wherein EUV radiation is generated, and further comprising the step of performing EUV projection lithography with the EUV radiation.

22. A method according to claim 1, further comprising the step of performing crystal analysis with the X-ray or EUV radiation.

23. A method according to claim 1, further comprising the step of performing microscopy with the X-ray or EUV radiation.

24. A method according to claim 1, further comprising the step of performing X-ray diffraction with the X-ray radiation.

25. A method according to claim 24, wherein the X-ray diffraction is performed for the purpose of protein structure determination.

26. A method according to claim 1, wherein the target jet is formed to have a propagation speed on the order of 10–1000 m/s in the area of interaction.

27. A method according to claim 1, wherein the target jet is formed to have a propagation speed of about 600 m/s in the area of interaction.

28. An apparatus for generating X-ray radiation, comprising a target generator arranged to form a target jet by urging a liquid substance through an outlet opening, the target jet propagating towards an area of interaction, an electron source for providing at least one electron beam and directing the at least one electron beam onto the jet in the area of interaction, the radiation being generated by the electron beam interacting with the jet, and wherein the electron source is controllable to effect interaction of the electron beam with the target jet at an intensity of the electron beam such that Bramsstrahlung and characteristic line emission is generated in the X-ray region, essentially without heating the jet to a plasma-forming temperature, and wherein the target generator is operative to generate the target jet to have a sufficiently high propagation speed in the area of interaction in order for the emission to be generated essentially without heating the jet to a plasma-forming temperature, the propagation speed being at least 10 m/s in the area of interaction.

29. An apparatus according to claim 28, wherein the substance comprises a solid, heated to a liquid state.

30. An apparatus according to claim 29, wherein the solid is a metal.

31. An apparatus according to claim 28, wherein the substance comprises a gas, cooled to a liquid state.

32. An apparatus according to claim 31, wherein the gas is a noble gas.

33. An apparatus according to claim 28, wherein the electron source is controllable to direct the electron beam onto the target jet at a distance from about 0.5 mm to about 10 mm from the outlet opening.

34. An apparatus according to claim 28, wherein the target generator is controllable to provide condensed matter in the area of interaction.

35. An apparatus according to claim 28, wherein the target generator is controllable to provide a spatially continuous portion of the jet, at least one droplet, or a spray of droplets or clusters in the area of interaction.

36. An apparatus according to claim 28, wherein the electron source is controllable to essentially match a transverse dimension of the electron beam to a transverse dimension of the jet by focusing the electron beam on the jet.

37. An apparatus according to claim 28, wherein the target generator is adapted to generate the jet with a diameter from about 1 $\mu$m to about 10,000 $\mu$m.

38. An apparatus according to claim 28, wherein the electron source is controllable to generate the electron beam by means of an acceleration voltage from about 5 kV to about 500 kV, and wherein the electron beam has an average beam current from about 10 mA to about 1000 mA.

39. An apparatus according to claim 38, wherein the target generator is operative to generate the target jet to have a propagation speed on the order of 10–1000 m/s in the area of interaction.

40. An apparatus according to claim 38, wherein the target generator is operative to generate the target jet to have a propagation speed of about 600 m/s in the area of interaction.

41. An apparatus according to claim 28, wherein the electron source is controllable for generation of at least one pulsed electron beam.

42. An apparatus according to claim 28, wherein the electron source is controllable for generation of at least one continuous electron beam.

43. An apparatus according to claim 28, wherein the target generator is operative to generate the target jet to have a propagation speed on the order of 10–1000 m/s in the area of interaction.

44. An apparatus according to claim 28, wherein the target generator is operative to generate the target jet to have a propagation speed of about 600 m/s in the area of interaction.

* * * * *